US007581664B2

(12) United States Patent
Richaud et al.

(10) Patent No.: US 7,581,664 B2
(45) Date of Patent: Sep. 1, 2009

(54) MULTI-OUTLET CASTING NOZZLE

(75) Inventors: Johan L. Richaud, Dundas (CA); Lawrence J. Heaslip, Burlington (CA); James Dorricott, Burlington (CA); Dong Xu, Mississauga (CA)

(73) Assignee: Vesuvius Crucible Company, Wilmington, DE (US)

( * ) Notice: Subject to any disclaimer, the term of this patent is extended or adjusted under 35 U.S.C. 154(b) by 318 days.

(21) Appl. No.: 10/579,858

(22) PCT Filed: Nov. 17, 2004

(86) PCT No.: PCT/US2004/038585

§ 371 (c)(1),
(2), (4) Date: May 17, 2006

(87) PCT Pub. No.: WO2005/049249

PCT Pub. Date: Jun. 2, 2005

(65) Prior Publication Data

US 2007/0102852 A1 May 10, 2007

Related U.S. Application Data

(60) Provisional application No. 60/520,613, filed on Nov. 17, 2003.

(51) Int. Cl.
*C21C 5/42* (2006.01)

(52) U.S. Cl. ..... 222/606; 266/236

(58) Field of Classification Search ..... 266/236; 222/594, 606, 607

See application file for complete search history.

(56) References Cited

U.S. PATENT DOCUMENTS

| | | | | |
|---|---|---|---|---|
| 4,949,778 | A | 8/1990 | Saito et al. | |
| 2007/0102852 | A1 * | 5/2007 | Richaud et al. | 266/236 |

FOREIGN PATENT DOCUMENTS

| | | | |
|---|---|---|---|
| DE | 10113026 | A1 | 10/2002 |
| EP | 0852166 | A2 | 7/1998 |

* cited by examiner

*Primary Examiner*—Scott Kastler
(74) *Attorney, Agent, or Firm*—Thomas J. Clinton; Donald M. Satina

(57) ABSTRACT

The present invention concerns a submerged entry nozzle for use in the continuous casting of liquid metal. The nozzle comprises a central bore and a plurality of pairs of discharge outlets. The cross-sectional area of the central bore decreases between pairs of discharge outlets, such that ratio of height to width of any outlet is one or less.

25 Claims, 8 Drawing Sheets

MULTI-OUTLET CASTING NOZZLE

CROSS-REFERENCE TO RELATED APPLICATIONS

This application claims the benefit under 35 U.S.C. §120 of the filing date of U.S. Provisional Application No. 60/520,613 filed Nov. 17, 2003.

FIELD OF THE INVENTION

The present invention generally relates to nozzles used for the continuous casting of liquid metal. More specifically, the present invention relates to an improved nozzle having a plurality of outlets.

DESCRIPTION OF THE RELATED ART

Liquid metal, and in particular liquid steel, is generally poured into a mold of a continuous casting machine through a casting nozzle. The casting nozzle generally comprises a refractory material and has a generally tube-like shape with an inlet to receive the liquid metal and one or more outlets to discharge the liquid metal. The liquid metal flows into the inlet of the nozzle, flows through the central bore of the nozzle, and flows out of at least one nozzle outlet. In the continuous casting of slabs, the nozzle is arranged generally vertically, with the outlet portion of the nozzle positioned within the upper part of a slab-shaped mold cavity so as to direct the metal flow into the upper part of the mold.

In slab casting, it is often desirable to design the nozzle such that its outflow is divided into a least two streams that exit the nozzle from opposite sides of the nozzle in a nearly horizontal direction toward the narrow faces of the slab-shaped mold cavity. In this way, the majority of the hot liquid metal flowing into the mold is directed by the nozzle across the width of the slab so as to not impinge directly on the broad faces of the slab mold and so as to not plunge directly downward into the slab. A near horizontal orientation of the exit-streams discharging from the nozzle helps to provide more uniform temperatures at the top of the liquid metal pool in the mold. It also helps to more uniformly melt the lubricating powder that is added to the top of the mold during casting and to avoid quality problems in the cast metal product such as cracking of the slab, or entrapment of non-metallic inclusions and gas bubbles in the cast metal products.

A typical arrangement of a casting nozzle 2 in a slab mold 4 is shown in FIG. 1. In order to provide that opposing liquid metal streams exit the casting nozzle 2 nearly horizontally, the nozzle 2 is generally configured so as to turn the liquid metal flow away from the vertical toward the horizontal by means of a closed bottom 6 directly below the central bore 8 and opposed lateral outlets 10, 12. The desired turning angle of the liquid metal flow in a casting nozzle 2 used for slab casting is generally in the range of 55 to 105 degrees away from the vertical toward the horizontal depending on slab mold widths, casting rates, casting alloys, etc. as known to those skilled in the art.

Typically, casing nozzles with a central bore, a single bottom closure, and lateral outlets are used to turn the liquid metal flow from the nozzle nearly horizontally. A single simple bottom closure prevents the direct downward escape of the flow from the nozzle and thus the flow must turn toward the horizontal to escape through the opposing lateral outlets of the nozzle. The axes of the lateral outlets form an angle with the vertical axis of the central bore, called the design turning angle, as illustrated in FIGS. 2, 3 and 6. For example, FIG. 2 illustrates a slab-casting nozzle having a design turning angle of 90 degrees and two opposing lateral outlets. FIG. 3 illustrates a slab-casting nozzle having a design turning angle of 55 degrees and two opposing lateral outlets. FIG. 6 illustrates a slab-casting nozzle having a design turning angle of 105 degrees and two opposing lateral outlets.

Previous nozzles suffer from several deficiencies: (1) the exit-streams do not achieve the design turning angle of the nozzles and their actual turning angle varies and wanders during casting operation, (2) the exit-streams do not generally fully utilize the open area of the lateral outlets, (3) the exit-streams have a non-uniform velocity with the nozzle-exit velocities in the lower portions of the exit-streams being significantly higher than the nozzle-exit velocities in the upper portions of the exit streams, (4) the exit-streams penetrate too deeply into the liquid pool in the mould, and (5) the exit streams spin and swirl in a turbulent and time-variant manner. These deficiencies lead to undesired and unstable patterns of liquid metal flow in the mold, the build-up of plugging deposits in the nozzle bore and nozzle outlets, and excessive turbulence in the nozzle exit-streams and in the liquid metal pool in the mold. The net effect of these deficiencies is to adversely affect the operational performance of the casting machine and adversely affect the quality of the cast slabs.

There have been attempts to address these problems in several ways that involve modifications to the design of the bottom closure of the nozzle. For example, to improve and stabilize the exit-streams flowing from the opposed lateral outlets, the bottom closure of the nozzle may be partially opened with a small hole 14 as shown in FIG. 4, to allow a relatively small portion of liquid metal flow to exit the nozzle a downward direction. A hole in the bottom closure weakens the exit-streams exiting the lateral outlets. Weakening the turned exit-streams reduces their wandering, but also reduces the quantity of flow that is turned toward the narrow faces of the mold and thus reduces the momentum or penetrating power of the turned exit-streams to reach the narrow ends of the mold. Further, if the bottom hole or holes are made too large, the near horizontal turning of the flow can be completely defeated.

Another way to improve and stabilize the exit-streams flowing from opposed lateral outlets is to provide a nozzle with a bottom closure located below the bottom of the outlets. A nozzle with a bottom closure located below the bottom of the outlets is shown in FIG. 5 and is referred to as a nozzle with a well-shaped bottom closure. Nozzles with a well-shaped bottom closure do not solve the above-mentioned deficiencies, as such nozzles still do not attain the design turning angle of the exit-streams and exit-stream wandering still occurs. The uniformity of exit-stream velocity is improved although not fully achieved with a well-shaped bottom casting nozzle, but swirling and turbulence of the exit-streams is increased, thereby decreasing their penetrating power and degrading the ability of the streams to reach the narrow faces of the mold with sufficient momentum to establish a consistent pattern of flow in the mold.

Another way to improve and stabilize the exit-streams flowing from opposed lateral outlets is to utilize upper and lower lateral outlets. A nozzle with upper and lower lateral outlets is shown in FIG. 12. The nozzle has a simple central bore with constant cross-sectional area and opposing upper and lower lateral outlets above a closed bottom. Such nozzles also do not solve the above-mentioned deficiencies. The proportion of the liquid metal flow that is discharged from the upper lateral outlets is significantly less than that discharged from the lower lateral outlets, unless the total open area of the lower outlets is small relative to the open area of the central bore. In that case, the exit-streams from the upper outlets do not achieve their design turning angle and are swirling, turbulent, unstable, and wandering. If the total open area of the lower outlets is generally equivalent to or greater than the open area of the central bore, little or no exit-stream flow will be discharged from the upper outlets and liquid metal can even flow into the nozzle through the upper outlets from the pool of metal in the mold, thus defeating the function of the nozzle. In either case, previous nozzles having a simple central bore with constant cross-sectional area and opposing upper and lower lateral outlets above a closed bottom do not solve the problems described above.

An alternate nozzle with upper and lower lateral outlets above a closed bottom, as disclosed in U.S. Pat. No. 4,949,778 to Saito et al, is shown in FIG. 7. Saito et al teach a casting nozzle, wherein at least one portion of the central bore of the nozzle is reduced in cross-sectional area in all radial directions around the central axis of the nozzle and opposed lateral outlets. The lateral outlets have a total open area not less than twice the cross-sectional area of the central bore before reduction, are arranged above and below the reduced portion or portions of the central bore. Saito et al also teach a set of mathematical relations between the open areas of the nozzle outlets, the open area of the central bore, the open areas of the central bore after reduction, and a discharge coefficient.

FIGS. 7(*a*), 7(*b*), and 7(*c*) are reproductions of the figures used in U.S. Pat. No. 4,949,778 referring to a first embodiment of the Saito et al invention. Saito et al teach reduction of sectional area of the central bore of a nozzle by reducing the diameter of the central bore, or in other words, by reducing the cross-sectional area of the central bore in all radial, or horizontal, directions around the vertical central axis of the central bore. This reduction forms a ledge-like surface that extends around the entire circumference or perimeter of the central bore and forms a bore below the ledge that is narrower in all radial directions than the bore above the ledge. Thus in accordance with the teachings of Saito et al, the lower outlets are restricted in width by the reduced bore and thus upper outlets are wider than lower outlets, and in accordance with the mathematical relations and other patent teachings, the lower outlets must be taller than they are wide.

However, it has been found that nozzles fashioned in accordance with the teachings of Saito et al in U.S. Pat. No. 4,949,778 have several deficiencies. The lower outlets have a high vertical aspect ratio, that is to say that their height is greater than their width and thus the exit-streams do not fully utilize the open area of the lower lateral outlets, and the exit-streams have a non-uniform velocity with the nozzle-exit velocities in the lower portions of the exit-streams being significantly higher than the nozzle-exit velocities in the upper portions of the exit streams. The presence of the circumferential ledge-like surface that extends around the entire perimeter of the central bore of the nozzle causes uncontrolled spinning and swirling of the upper exit-streams that are discharged from the upper outlets. Another deficiency is that, in the case of multiple reduction of the central bore, the uppermost outlets approach close to the surface or meniscus of the liquid metal in the mould increasing the level fluctuation and turbulence at the meniscus.

SUMMARY OF THE INVENTION

It is an object of the present invention to provide a submerged entry nozzle for use in the continuous casting of liquid metal, the nozzle comprising a body having a central bore through most of the body, the bore terminating in a closed end a plurality of pairs of discharge outlets symmetrically disposed about a longitudinal axis of the nozzle characterized in that the cross-sectional area of the central bore decreases between pairs of discharge outlets, and wherein the ratio of height to width of any outlet is one or less.

It is a further object of the present invention to provide a submerged entry nozzle for use in the continuous casting of liquid metal, the nozzle comprising a body having a central bore through most of the body, the bore terminating in a closed end a plurality of pairs of discharge outlets symmetrically disposed about a longitudinal axis of the nozzle characterized in that the cross-sectional area of the central bore decreases between pairs of discharge outlets, and wherein the width of outlets closer to the closed end of the nozzle have the same width as outlets further from the closed end of the nozzle.

BRIEF DESCRIPTION OF THE SEVERAL FIGURES

Figure 1:
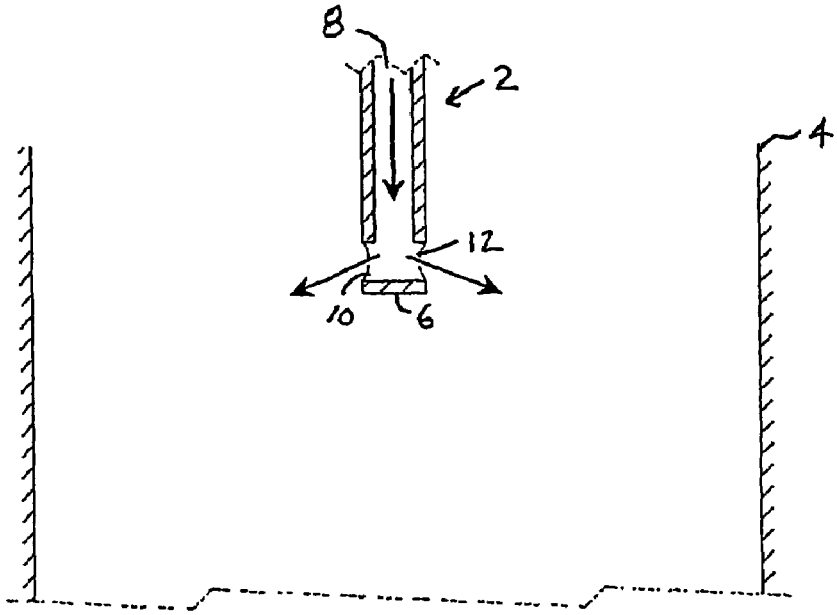
Fig. 1 PRIOR ART
FIG. 1 is a schematic view of a traditional casting nozzle and casting system.
Figure 2:
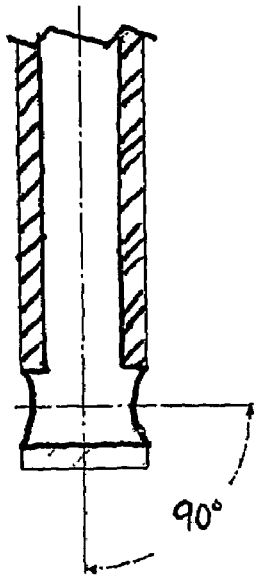
Fig. 2 PRIOR ART
FIG. 2 is a cross-sectional view of a traditional casting nozzle.
Figure 3:
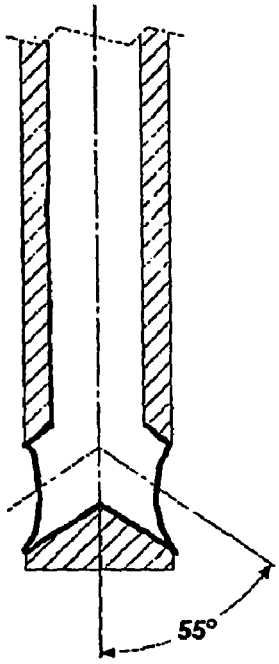
Fig. 3 PRIOR ART
FIG. 3 is a cross-sectional view of another traditional casting nozzle.
Figure 4:
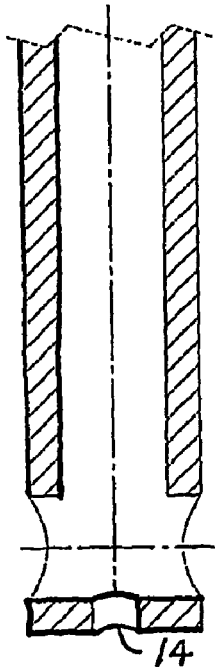
Fig. 4 PRIOR ART
FIG. 4 is a cross-sectional view of another traditional casting nozzle.
Figure 5:
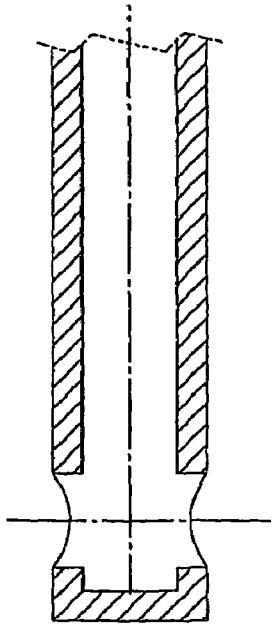
Fig. 5 PRIOR ART
FIG. 5 is a cross-sectional view of another traditional casting nozzle.
Figure 6:
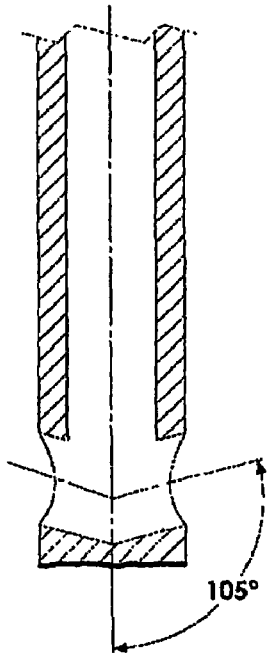
Fig. 6 PRIOR ART
FIG. 6 is a cross-sectional view of another traditional casting nozzle.
Figure 7:
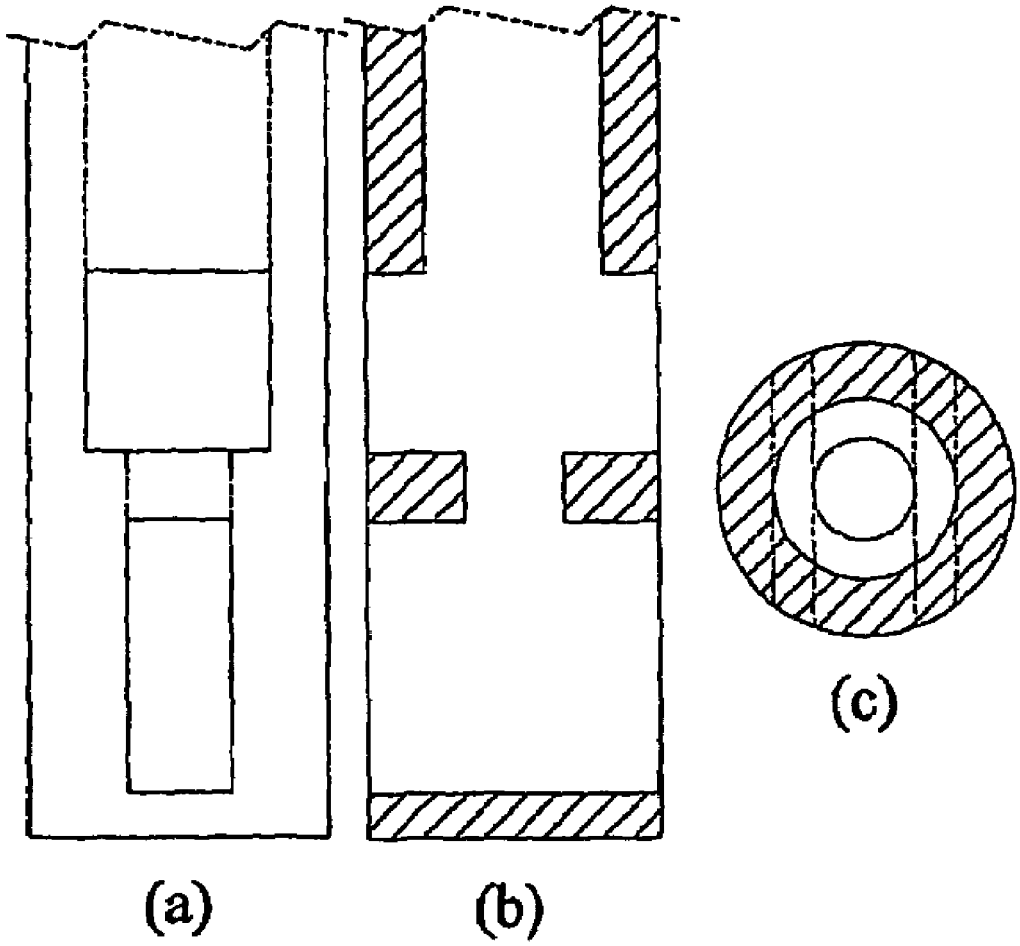
Fig. 7 PRIOR ART

FIG. 7*a* is a perspective view of another traditional casting nozzle.

FIG. 7*b* is a cross-sectional view of the traditional casting nozzle of FIG. 7*b*.

FIG. 7*c* is an end view of the traditional casting nozzle of FIG. 7*a*.

FIG. 8*a* is a cross-sectional view of a casting nozzle in accordance with a first embodiment of the present invention.

FIG. 8*b* is a cross-sectional view of the casting nozzle of FIG. 8*a* taken along line 8*b*-8*b*.

Figure 8:
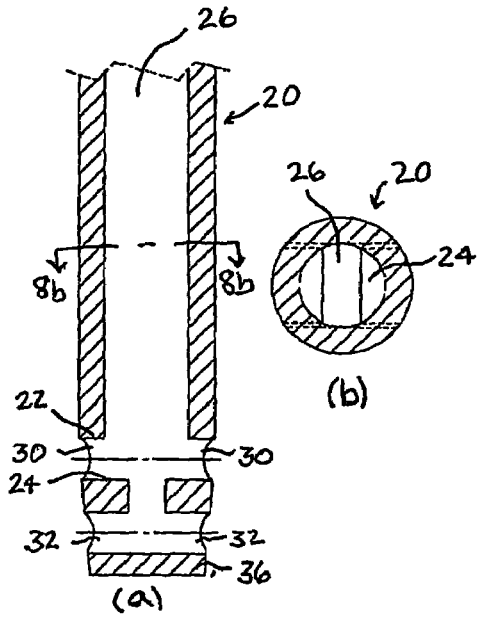
Figure 9:
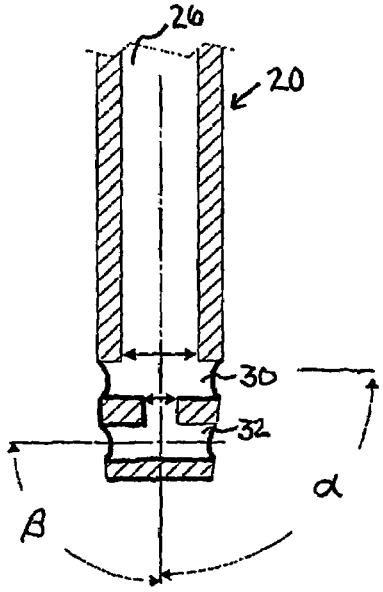

FIG. 9 is a cross-sectional view of the casting nozzle of FIG. 8*a*.

FIG. 10*a* is a cross-sectional view of a casting nozzle in accordance with an alternate embodiment of the present invention.

FIG. 10*b* is a cross-sectional view of the casting nozzle of FIG. 10*a* taken along line 10*b*-10*b*.

Figure 10:
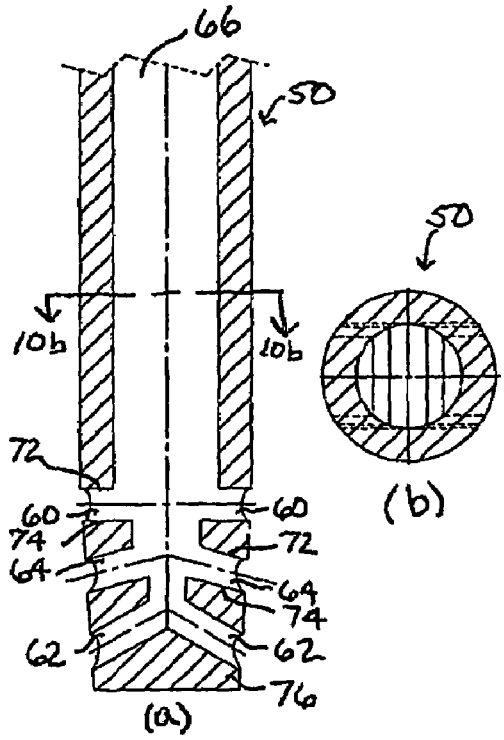
Figure 11:
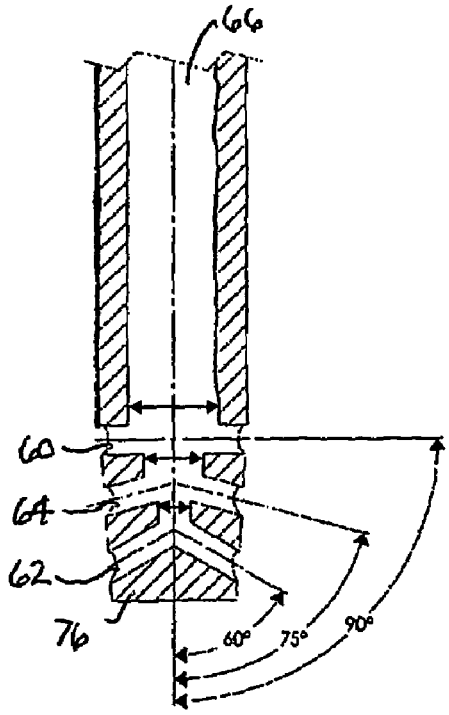

FIG. 11 is a cross-sectional view of the casting nozzle of FIG. 10*a*.

Figure 12:
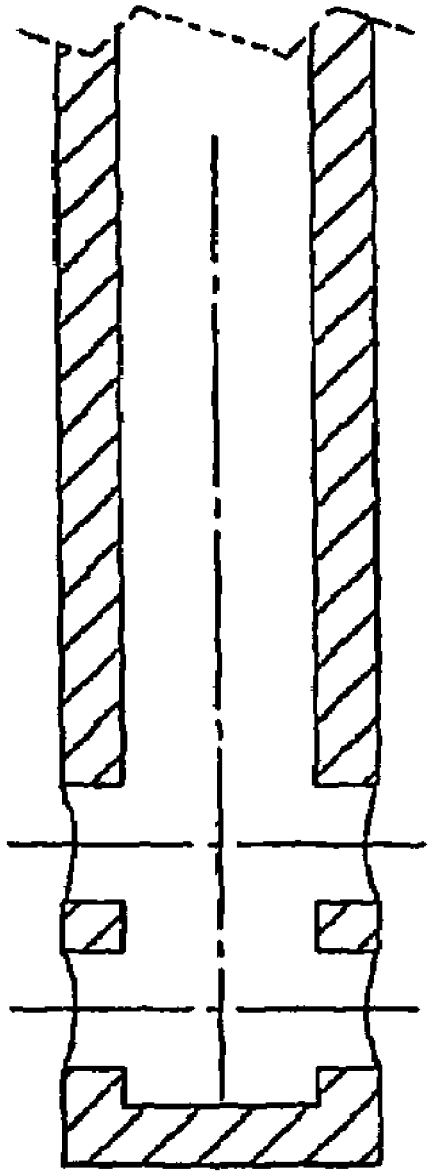
Fig. 12 PRIOR ART

FIG. 12 is a cross-sectional view of another traditional casting nozzle.

Figure 13:
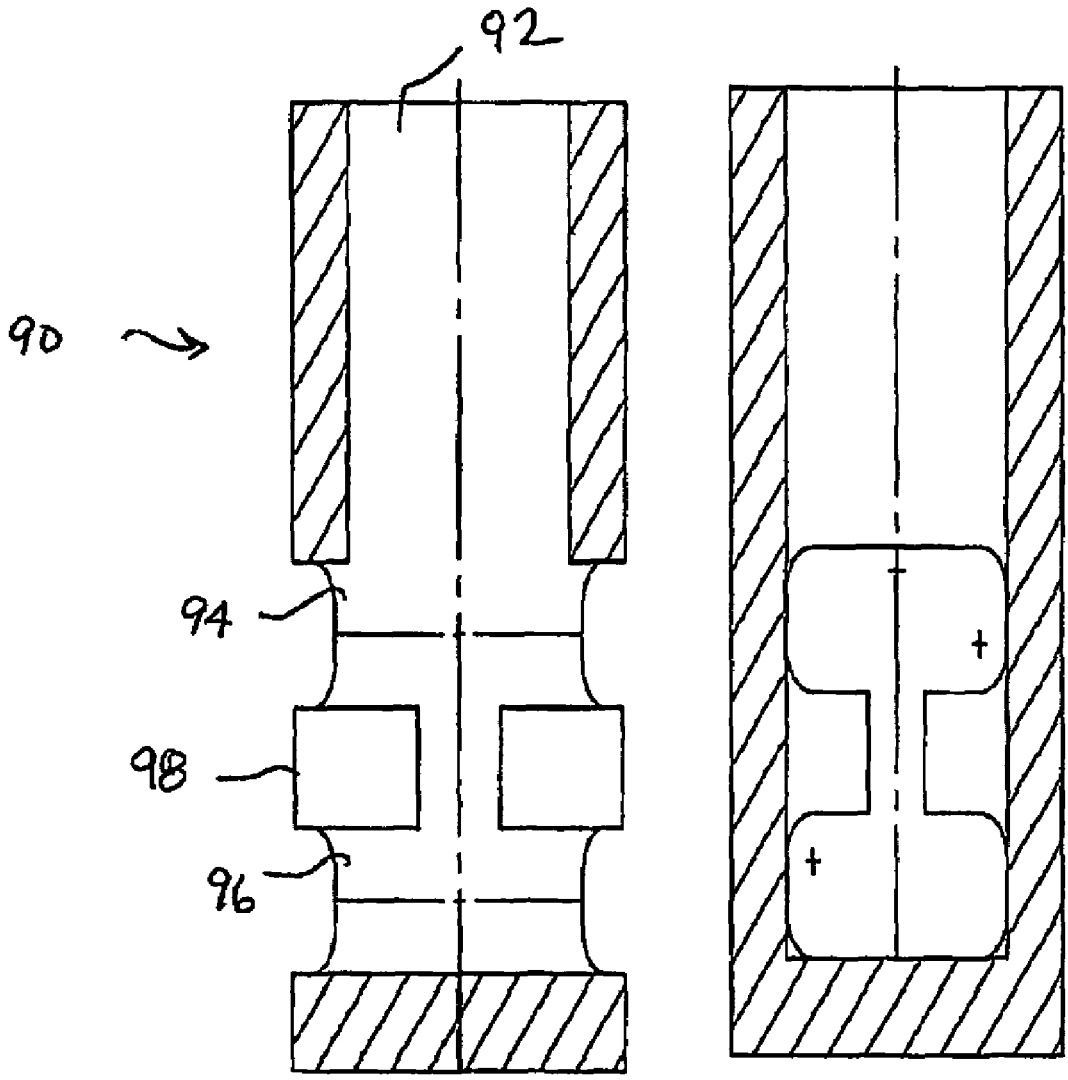

FIG. 13*a* is a cross-sectional view of casting nozzle in accordance with an alternate embodiment of the present invention.

FIG. 13*b* is a cross-sectional view of the casting nozzle of FIG. 13*a*.

DETAILED DESCRIPTION OF THE PREFERRED EMBODIMENTS

FIGS. 8 and 9 illustrate a first embodiment of a casting nozzle 2. This embodiment of the invention comprises one opposing pair of upper lateral outlets 30 and one opposing pair of lower lateral outlets 32. In this embodiment, the design turning angle $\alpha$ from the vertical upward toward the horizontal of the upper outlets is 90 degrees as is the design turning angle β of the lower outlets 32. Each upper outlet 30 is defined by an upper edge 22 and a lower edge 24. The central bore 26 of the casting nozzle 20 is laterally constricted by the lower edges 24 of the upper outlets 30. The lateral constriction is formed by the intrusion of only the lower edges 24 of the upper outlets 30 into the central bore 26 and thus the lateral opening of the central bore 26 above the upper edges 22 of the upper outlets 30 is greater than the lateral opening of the central bore 26 at the lower edges 24 of the upper outlets 30.

The lower outlets 32 are located below the constriction and above a bottom closure 36. A lateral constriction does not take the form of a circumferential ledge-like surface that extends around the entire perimeter of the central bore 26 of the nozzle 20. As can be seen in FIG. 9, a lateral constriction only reduces the lateral opening of the central bore 26, and thus the dimension of the central bore 26 opening at 90 degrees to the lateral opening is unchanged. The design turning angles α, β of the upper and lower outlets 30, 32 need not be necessarily equal to 90 degrees. Also the design turning angles α, β of the upper and lower outlets 30, 32 can differ. In either case, the design turning angles α, β may be in the range of 30 to 105 degrees as measured from the vertical upward toward the horizontal in order that the nozzle 20 achieves multiple exit-streams turned nearly horizontally relative to the vertical central bore 26.

Preferably, the width of the lower lateral outlets 32 are not decreased with respect to the width of the upper lateral outlets 30 and the height of the lateral outlets 30, 32 is preferably less than the width of the lateral outlets 30, 32. The total open area of the lateral outlets 30, 32 is preferably less than twice the open area of the central bore 26 of the nozzle 26 above the outlets 30, 32, and preferably more than equal to the open area of the central bore 26 of the nozzle 20 above the outlets 30, 32. The nozzle 20 achieves the desired turning of the flow toward the near horizontal, while achieving, better filling of the outlets by the exit-streams. This inhibits clogging and generates more uniform exit-flow velocities and more stable and controlled exit-streams with significantly reduced spinning and swirling. As a result, a more desirable and consistent pattern of flow in the mould is provided.

In alternate embodiments, the achieved turning angles of the exit-streams are controlled by the angles of the lower edges of the outlets relative to the vertical central axis of the bore and multiple turning angles and multiple constrictions can be used FIGS. 10 and 11 illustrate an embodiment of a casting nozzle of the present invention. The nozzle 50 comprises two opposing pairs of upper lateral outlets 60, 64 above one another and one opposing pair of lower lateral outlets 62 below. In this embodiment, the design turning angle from the vertical toward the horizontal of the top upper outlets 60 is 90 degrees, the design turning angle of the middle upper outlets 64 is 75 degrees, while the design turning angle of the lower outlets 62 is 60 degrees.

Each upper outlet 60 is defined by an upper edge 72 and a lower edge 74. The central bore 66 of the casting nozzle 50 is constricted in only the lateral direction by the lower edges 74 of the upper outlets 60. Each lateral constriction is formed by the intrusion of the lower edges 74 of the upper outlets 60 into the central bore 66 and thus the lateral opening of the central bore 66 above the upper edge 72 of an upper outlet 60 is greater than the lateral opening of the central bore 66 at the lower edge 74 of the same upper outlet 60. This embodiment of the invention comprises two constrictions. Considering the lateral opening of the central bore 66 at the top edge 72 of the uppermost outlets 60, 64 and moving downward in the direction of the flow through the central bore 66, only the lateral opening of the central bore 66 is decreased in a step-wise manner with each successive constriction. The lateral constrictions do not take the form of circumferential ledge-like surfaces that extend around the entire perimeter of the central bore 66 of the nozzle 50.

As discussed with respect to the previous embodiment, the lateral constrictions only reduce the lateral openings of the central bore 66, and thus the dimension of the central bore 66 opening at 90 degrees to the lateral openings 60, 62, 64 is unchanged. The lowermost outlets 62 are located below the lowermost constriction and above the bottom closure 76. Preferably, the width of a lateral outlet 62, 64 does not decrease with respect to the width of an above lateral outlet 60, 62 respectively, and the height of the lateral outlets 60, 62, 64 is preferably less than the width of the lateral outlets 60, 62, 64. The total open area of the lateral outlets 60, 62, 64 is preferably less than twice the open area of the central bore 66 of the nozzle 50 above the outlets 60, 62, 64 and more than equal to the open area of the central bore 66 of the nozzle 50 above the outlets 60, 62, 64.

FIGS. 13*a* and 13*b* illustrate an alternate embodiment of the present invention. The casting nozzle 90 is configured similar to the embodiments described above. However, the lateral constrictions 98 that decrease the area of central bore 92 do not extend fully across the central bore 92. In order to achieve the desired flow characteristics, the width of lateral opening 97 should be no more than half the diameter of the central bore 92.

At least one lateral constriction of the central bore 66 of the casting nozzle 50 by the intrusion into the central bore 66 of the lower edge 74 of an upper outlet 60, above a lower outlet 62, 64 of the nozzle 50, and above a bottom closure 76 of the nozzle 50 is a feature of the invention. The bottom 76 of the nozzle 50 must be essentially closed to stabilize the backpressure in the liquid metal flowing through the nozzle 50 and at least one lateral constriction is used to turn a certain portion of the flow to form an upper exit stream, while a remainder of the flow is subsequently turned by the bottom closure 76 to from a lower exit stream. This sequential division and turning of the flow in a nozzle 50 of the present invention causes the discharge rate and velocity of liquid metal issuing from each outlet, and the discharge angles of the exit streams, to display significantly less fluctuation as compared to traditional nozzles. A lateral constriction does not take the form of a circumferential ledge-like surface that extends around the entire perimeter of the central bore 66 of the nozzle 50. Instead, a lateral constriction only reduces the lateral opening of the central bore 66, the dimension of the central bore opening at 90 degrees to the lateral opening is unchanged by a constriction of the invention. Thus no decrease in the width of lower lateral outlets with respect to the width of upper lateral outlets is required and low vertical aspect ratios of the lateral outlets are allowed. The vertical aspect ratio of a lateral outlet is defined as the ratio of outlet height to outlet width. Preferably, all of the lateral outlets have vertical aspect ratios less than one. It has been found that low vertical aspect ratios of the lateral outlets remarkably stabilize the exit-streams to achieve, as compared to traditional nozzles, better filling of the outlets to inhibit clogging, more uniform exit-flow velocities of the exit-streams, significantly reduced spinning and swirling of the exit-streams, and a surprisingly consistent pattern of flow in the mould with less turbulence. A casting nozzle of the invention with low vertical aspect ratios of the outlets and with a total open area of the lateral outlets less than twice, and more than equal to, the open area of the central bore above the outlets allows close approach of the uppermost outlets to the meniscus, and thus even more than two constrictions can be utilized without fear of meniscus disruption.

In nozzles of the invention, multiple nearly horizontal upper and lower exit-streams with turning angles between 55 and 105 degrees from the vertical toward the horizontal are readily and stably achieved. The achieved turning angles more closely match the design turning angles, as compared to traditional nozzles. Different steady turning angles of the upper exit streams and lower exit streams can be readily realized, as well as a more certain and stable division of the flow into multiple upper and lower exit-streams. This accomplishes a highly diffuse, but still near horizontal, introduction of liquid metal into a slab mold, that is highly desirable for high-throughput casting and overcomes the deficiencies of the prior art.

Adjusting the extent of a lateral constriction controls the proportion of the liquid metal flow that exits the nozzle through the upper outlet whose lower edge protrudes into the central bore to form the constriction. The extent of the lateral constriction is defined by the ratio of the open area of the central bore in the horizontal plane at the constriction as compared to the open are of the central bore in a horizontal plane above the constriction. Thus the designer can adjust with greater certainty and simplicity, as compared to traditional nozzles, the proportions of the total flow exiting a nozzle of the invention through each upper lateral outlet.

Obviously, numerous modifications and variations of the present invention are possible. It is, therefore, to be understood that within the scope of the following claims, the invention may be practiced otherwise than as specifically described.

We claim:

1. A submerged entry nozzle for use in the continuous casting of liquid metal, the nozzle comprising: a) a body having a central bore through most of the body, the bore terminating in a closed end; b) a plurality of pairs of discharge outlets symmetrically disposed about a longitudinal axis of the nozzle; wherein the cross-sectional area of the central bore decreases between pairs of discharge outlets, and wherein the ratio of height to width of any outlet is one or less, wherein the total area of all outlets is less than twice the cross-sectional area of the central bore that is perpendicular to the flow of the liquid metal, and wherein all discharge outlets are directed at an angle not greater than approximately 90 degrees to the end of the longitudinal axis of the nozzle directed towards the closed end of the bore.

2. The submerged entry nozzle of claim 1, wherein the width of outlets closer to the closed end of the nozzle have the same width as outlets further from the closed end of the nozzle.

3. The submerged entry nozzle of claim 1, wherein the total area of all outlets is at least equal to the cross-sectional area of the central bore that is perpendicular to the flow of the liquid metal.

4. The submerged entry nozzle of claim 1, wherein the nozzle comprises at least two pairs of outlets.

5. The submerged entry nozzle of claim 1, wherein the nozzle comprises three pairs of outlets.

6. The submerged entry nozzle of claim 1, wherein the angle formed between each pair of outlets and the longitudinal axis of the nozzle is between approximately 30 and approximately 90 degrees.

7. The submerged entry nozzle of claim 1, wherein the angle formed between the pair of outlets furthest from the closed end and the longitudinal axis of the nozzle is approximately 90 degrees.

8. The submerged entry nozzle of claim 1, wherein the angle formed between each pair of outlets and the longitudinal axis of the nozzle is approximately 90 degrees.

9. The submerged entry nozzle of claim 1, wherein the angle formed between each pair of outlets and the longitudinal axis of the nozzle is different from the angle formed between each of the other pairs of outlets and the longitudinal axis of the nozzle.

10. The submerged entry nozzle of claim 5, wherein the angle formed between each of the pairs of outlets and the longitudinal axis of the nozzle is approximately 60 degrees, 75 degrees and 90 degrees, respectively.

11. The submerged nozzle of claim 1, wherein the cross-sectional area of the central bore is not decreased around the entire circumference of the central bore.

12. The submerged nozzle of claim 11, wherein the cross-sectional area of the central bore is not decreased in a radial direction that is perpendicular to the radial direction of the outlets.

13. The submerged nozzle of claim 12, wherein the cross-sectional area of the central bore is not decreased continuously in a radial direction that is perpendicular to the radial direction of the outlets.

14. A submerged entry nozzle for use in the continuous casting of liquid metal, the nozzle comprising: a) a body having a central bore through most of the body, the bore terminating in a closed end; b) a plurality of pairs of discharge outlets symmetrically disposed about a longitudinal axis of the nozzle; wherein the cross-sectional area of the central bore decreases between pairs of discharge outlets, and wherein the width of outlets closer to the closed end of the nozzle have the same width as outlets further from the closed end of the nozzle, wherein the total area of all outlets is less than twice the cross-sectional area of the central bore that is perpendicular to the flow of the liquid metal, and wherein all discharge outlets are directed at an angle not greater than approximately 90 degrees to the end of the longitudinal axis of the nozzle directed towards the closed end of the bore.

15. The submerged entry nozzle of claim 14, wherein the total area of all outlets is at least equal to the cross-sectional area of the central bore that is perpendicular to the flow of the liquid metal.

16. The submerged entry nozzle of claim 14, wherein the nozzle comprises at least two pairs of outlets.

17. The submerged entry nozzle of claim 14, wherein the nozzle comprises three pairs of outlets.

18. The submerged entry nozzle of claim 14, wherein the angle formed between each pair of outlets and the longitudinal axis of the nozzle is between approximately 30 and approximately 90 degrees.

19. The submerged entry nozzle of claim 14, wherein the angle formed between the pair of outlets furthest from the closed end and the longitudinal axis of the nozzle is approximately 90 degrees.

20. The submerged entry nozzle of claim 14, wherein the angle formed between each pair of outlets and the longitudinal axis of the nozzle is approximately 90 degrees.

21. The submerged entry nozzle of claim 14, wherein the angle formed between each pair of outlets and the longitudinal axis of the nozzle is different from the angle formed between each of the other pairs of outlets and the longitudinal axis of the nozzle.

22. The submerged entry nozzle of claim 18, wherein the angle formed between each of the pairs of outlets and the longitudinal axis of the nozzle is approximately 60 degrees, 75 degrees and 90 degrees, respectively.

23. The submerged nozzle of claim 14, wherein the cross-sectional area of the central bore is not decreased around the entire circumference of the central bore.

24. The submerged nozzle of claim 23, wherein the cross-sectional area of the central bore is not decreased in a radial direction that is perpendicular to the radial direction of the outlets.

25. The submerged nozzle of claim 23, wherein the cross-sectional area of the central bore is not decreased continuously in a radial direction that is perpendicular to the radial direction of the outlets.

* * * * *